United States Patent [19]

Smith

[11] Patent Number: 5,025,965

[45] Date of Patent: Jun. 25, 1991

[54] BACKPACK WITH COMBINATION BELT, BELT-RECEIVING POCKET AND CLOSURE THEREFOR

[76] Inventor: Patrick D. Smith, 12790 West 6th Pl., Golden, Colo. 80401

[21] Appl. No.: 574,791

[22] Filed: Aug. 30, 1990

Related U.S. Application Data

[63] Continuation-in-part of Ser. No. 245,023, Sep. 16, 1988.

[51] Int. Cl.[5] ..... A45F 4/00

[52] U.S. Cl. ..... 224/151; 224/224; 224/215; 224/901

[58] Field of Search ..... 224/224, 151, 153, 191, 224/211, 215, 216, 229, 235, 236, 237, 240, 242, 262, 901

[56] References Cited

U.S. PATENT DOCUMENTS 4,029,243 6/1977 Zerobuick et al. ..... 224/224
4,332,379 6/1982 Bannister ..... 224/215
4,449,654 5/1984 Cappis ..... 224/224
4,545,414 10/1985 Baum ..... 224/908

*Primary Examiner*—Linda J. Sholl
*Attorney, Agent, or Firm*—Richard W. Hanes

[57] ABSTRACT

This invention relates to a backpack having a combination waist-encircling belt, belt storage compartment and closure therefor characterized by a pouch open at both ends secured to the front panel of the pack, sections of a waist-encircling belt fastened alongside the open pouch ends positioned and adapted for insertion into the latter. The invention also encompasses a construction in which elements of a two part fastener are carried by the belt sections and pouch which move into a juxtaposed mating relationship thus defining closures for the open end pouch when the belt sections are stowed. The invention further encompasses an improved anatomically-contoured waist-encircling belt for use with backpacks, both frameless and with frames.

7 Claims, 2 Drawing Sheets

10
30
26
28
20
36T
38
18
40
22R
54T
12
44R
38
36B
46
42
34
40
56
54B
24

BACKPACK WITH COMBINATION BELT, BELT-RECEIVING POCKET AND CLOSURE THEREFOR

BACKGROUND OF THE INVENTION

This application is a continuation-in-part application of U.S. Ser. No. 07/245,023, filed Sept. 16, 1988 now abandoned.

FIELD OF THE INVENTION

Small frameless backpacks or so-called "day packs" are becoming quite popular with students for carrying their books and other supplies, mothers with small children who need to keep both arms free and, of course, for hikers and bikers to use on short jaunts where the greater capacity of a framed pack is unnecessary. For the most part, these frameless day packs require shoulder straps which pass over the shoulders of the wearer and back under the arms. In many instances these same packs have a small waist-encircling belt.

I have developed a small day pack which differs from other such packs in that it eliminates the over-the-shoulder straps in favor of a pair of angled straps that extend upwardly and rearwardly from points of attachment to a wide uniquely-shaped waist-encircling belt alongside the wearer's body to the side margins of the pack in approximately the area of the shoulder blades. In the preferred embodiment of my pack forming the subject matter hereof, I provide the belt with wide anatomically-contoured flaps in the hip area which cooperate with the aforementioned angled straps to hold the pack securely against the back of the wearer without having to use shoulder straps. I also provide my pack with a simple carrying handle in the form of a pair of web straps which are used when the pack is carried as a satchel and not a backpack. When used in this fashion, however, getting the wide anatomically-contoured flaps and attached straps that define the waist-encircling belt out of the way along with the angled straps attached thereto presents a problem.

I have also found that a need exists for convenient belt-stowage in the larger backpacks with rigid frames and the conventional over-the-shoulder straps since this style of pack is oftentimes carried over one shoulder using only one of its two shoulder straps and no belt. Both frameless and rigid-framed backpacks, therefore, can benefit from my belt-stowage feature.

DESCRIPTION OF THE RELATED ART

The most pertinent prior art known to me is found in an earlier version of my own frameless pack which also did away with the conventional shoulder straps and replaced them with the above-described angled straps, this earlier version forming the subject matter of U.S. application Ser. No. 405,522, now abandoned. It differed significantly, however, from the one forming the subject matter of my present application in that it had no waist-encircling belt which included anatomically-contoured flaps in the hip and lower back area nor did it include the unique combination belt-receiving storage compartment and closure for the latter wherein parts of the belt and its pouch cooperate to define the means by which the open pouch ends are closed.

SUMMARY OF THE INVENTION

The present invention relates, therefore, to a unique backpack frameless or otherwise which is characterized by a belt-receiving pouch open at both ends and within the open ends of which are folded and secured the ends of both wide waist-encircling belt sections. Overlying these belt sections within the open ends of the pouch are parts of mating two-part fasteners, the other parts of which are secured to the remote face of the belt sections adjacent their points of attachment. With the belt sections in waist-encircling relation, the parts of the fasteners carried thereby are essentially hidden and lie against the wearer's back. On the other hand, when these belt sections are disconnected from one another, folded and placed into the pouch through the open ends of the latter, the mating parts of the fasteners are brought into a face-to-face relationship where they can be secured to close it up, thus retaining the belt along with the major portions of the angled straps attached thereto so that they are all out of the way for convenience in carrying by the handles.

Another important aspect of the invention is the shape and location of the waist-encircling belt which is anatomically-matched, so-to-speak, to the body of the wearer. Specifically, it includes a pair of wide flaps starting at their widest point of attachment to the pack in the small of the back immediately above the buttocks and ranging forwardly therefrom up and over the hip bones to points of termination in the stomach area where the relatively narrower interconnectable strap sections begin. These flaps, while not padded so that they will fold and can be stored in the pouch, nevertheless, remain comfortable to wear and, in the case of the frameless day pack version, require no shoulder straps.

It is, therefore, the principal object of the present invention to provide a novel and improved backpack.

A second objective is that of providing a pack of the type described which included an anatomically-contoured waist-encircling belt along with a pouch for storing same.

Another object of the within-described invention is to provide a unique combination of a waist-encircling belt and storage compartment therefor in which each of the elements thus combined carry separate parts of a two part closure that come into a juxtaposed position for fastening only when the belt sections are opened and folded into the compartment.

Yet another objective of the invention forming the subject matter hereof is that of providing a uniquely-contoured waist belt which includes a pair of non-padded flaps that have their points of attachment located low down on the back just above the buttocks and curve upwardly therefrom over the hips to points of termination in the stomach area where the connectable straps begin.

An additional objective is to provide a backpack characterized by a storable waist belt, to the side margins of which are secured a pair of upwardly and rearwardly angled straps that assume a position adapted to hold the pack snugly against the wearer's back when the belt is in waist-encircling position but which largely disappear into the pouch when the belt is opened and stored in the latter.

Further objects are to provide a frameless or frame-carrying backpack which is simple, lightweight, versatile, easy to load and unload, rugged, comfortable to wear, compact and decorative in appearance.

Other objects will be in part apparent and in part pointed out specifically hereinafter in connection with the description of the drawings which follows.

DESCRIPTION OF THE PREFERRED EMBODIMENTS

Figure 1:
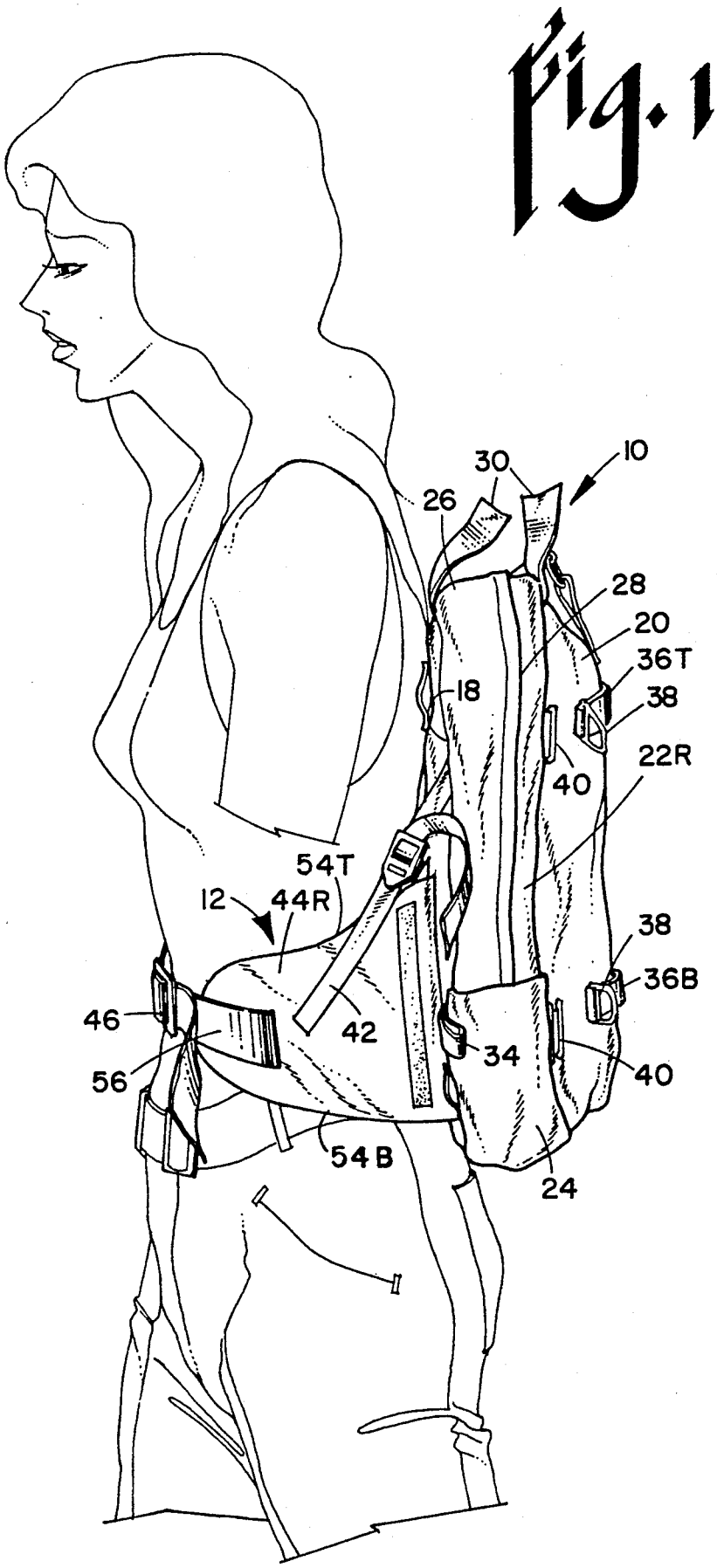
FIG. 1 is a perspective view showing the frameless version of the backpack of the present invention detachably held in place upon the back of a hiker by means of the belt and angled straps in their operative positions.

Referring next to the drawings for a detailed description of the present invention, reference numeral 10 has been selected to refer to a frameless version of the backpack in a general way while numerals 12 and 14 have been chosen to similarly designate its waist-encircling belt and the pouch therefor, respectively. The bag-forming portion of the pack is more or less conventional consisting of a front panel 18, a rear panel 20, sidewalls 22R and 22L, a bottom wall 24 and top wall 26, all made of heavy fabric and sewn together to form a top-opening receptacle or bag. A zippered opening 28 (FIG. 1) extends along the top and part way down both sides. The top also includes a pair of carrying handles 30 bordering the aforementioned zippered opening. The front panel of the bag-forming portion of the pack includes various other features such as the pair of loops shown at 32 in FIG. 2 and the similar ones seen at 34 in FIGS. 1, 3 and 4, none of which is pertinent to the present invention. In like fashion, the rear panel 20 carries upper and lower horizontally-disposed straps 36T and 36B with D-rings 38 at the ends thereof which lie adjacent connectors 40 which can be strapped or otherwise connected together to provide additional carrying capacity on the outside of the pack. Once again, these features, while adding considerably to utility and versatility of the pack, form no part of the present invention.

Figure 2:
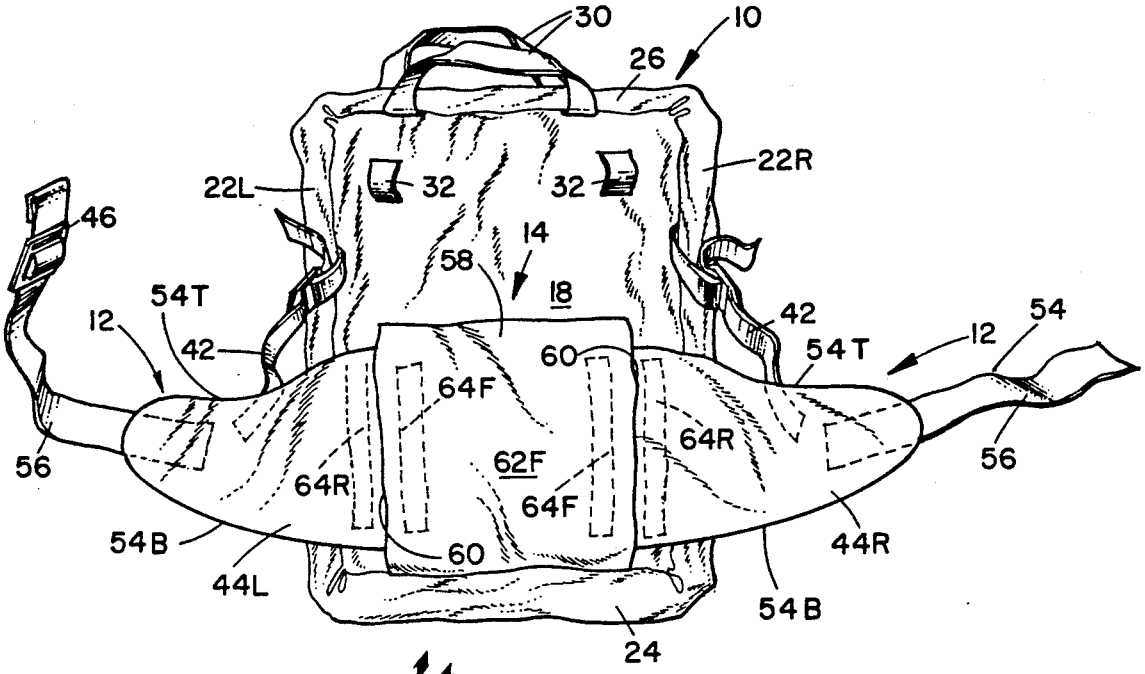
FIG. 2 is a front elevation of the pack itself showing the sections of the waist-encircling belt disconnected from one another and ready for insertion into the open ends of the pouch.
Figure 3:
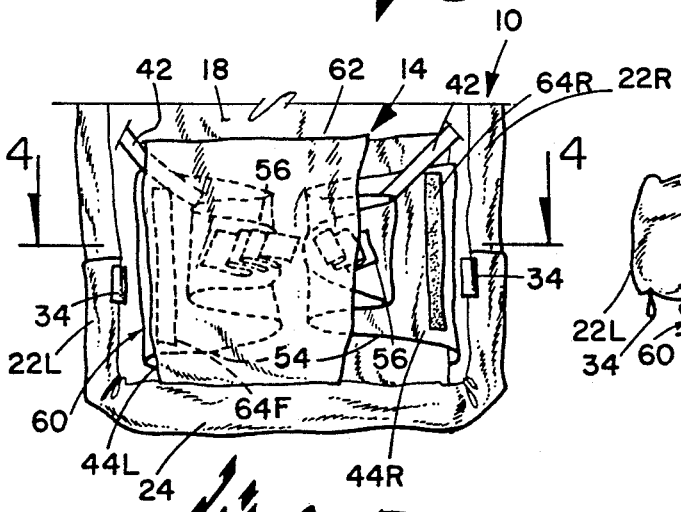
FIG. 3 is a fragmentary front elevation similar to FIG. 2 and to the same scale but differing therefrom in that the strap sections are shown stowed in the pouch, portions of the latter having been broken away to more clearly reveal the interior construction; and, FIG. 4 is a horizontal section taken along lines 4—4 of FIG. 3.
Figure 4:
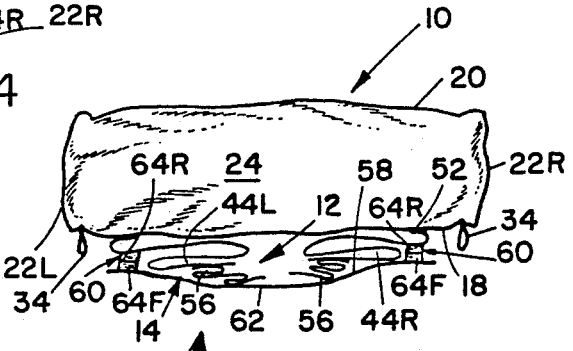

With particular reference to FIGS. 1, 2 and 3, a pair of angled straps 42 will be seen connected to the front panel 18 of the bag-forming portion in transversely-spaced relation to one another and at about shoulder-blade height. These straps angle downwardly and forwardly as seen in FIG. 1 to points of attachment to the waist-encircling belt 12 at approximately the so-called "point" of the wearer's hips. With the belt fastened as shown in FIG. 1, these straps will cooperate with the belt 12 to pull the pack snugly into the "small" of the wearer's back without having to resort to shoulder straps in the small "day pack" version illustrated here although the full size backpacks still require shoulder straps. While this inclined arrangement of straps 42 was present in an earlier version of my backpack, the way in which they cooperate with the belt 12 and fold into the pouch 14 as shown in FIGS. 3 and 4 so as to essentially disappear and stay completely out of the way is unique to this design. Also unique is the anatomically-contoured flap which will now be described in detail.

Looking specifically for the moment at FIG. 2, belt 12 will be seen to comprise two sections, 44R and 44L. It should, perhaps, be mentioned that the designations "R" and "L" referring respectively to "right" and "left" have been used herein to refer to the pack as seen in elevation in FIG. 2, not as the wearer would see it with his or her back to the pack. Thus, the belt section 44R will be on the wearer's left side as will the left sidewall 22R as shown.

To continue, these two belt sections differ from one another in only one respect, namely, left-hand section 44L carries a buckle 46. This particular belt differs significantly from other waist-encircling belts, at least those used with backpacks, in that the respective sections include wide anatomically-contoured flaps 44L and 44R that extend from a line of attachment alongside the opening 60 in the pouch 14 opposite the wearer's lumbar back upwardly and forwardly over the hips to points of termination in the stomach area at the front of the wearer's body. These flaps 44L and 44R at their widest point, where they emerged from underneath the pouch, are between approximately six and seven inches wide extending from near the bottom wall 24 of the bag up about half way on the front panel 18 as can be seen most clearly in FIGS. 1 and 2. In the particular form illustrated, the adjacent ends 52 (FIG. 4) of these flaps are sewn directly to the front panel 18 and the pouch 14 sewn on top however, obviously, other arrangements could be used without departing from the functional aspects of the invention to be explained in detail presently.

While the angle at which the flaps 44L and 44R are seen in FIGS. 1 and 2 and the curvature thereof make the difference in length between the lower flap margin 54B and the upper one 54T somewhat less apparent than it actually is, nevertheless, the lower edge 54B is, in fact, substantially longer than the top edge 54T. This being the case, these flaps range generally forwardly and upwardly from points of attachment to the bag normally positioned low down in the small of the wearer's back, just above the buttocks to points of termination in the stomach area after curving up and over the hips. The upper margin 54T, on the other hand, is significantly shorter and, in the particular form shown, actually cut somewhat concave to pass around and underneath the rib cage.

The resulting waist-encircling belt is anatomically-contoured to fit snugly and comfortably against the back and between the hips and rib cage without the necessity for internal padding or, in the case of the day pack version, any shoulder straps.

The free or remote ends of these flaps approach one another in spaced-apart relation in the front of the wearer's stomach area where narrower web straps 56 define continuations thereof that connect together in conventional fashion by a buckle 46, as seen in FIG. 1. If desired, of course, the flaps themselves could provide the means for connecting one to the other thus eliminating the need for the straps.

Pouch 14 is in the form of a short sleeve having openings 60 at both of its ends where the flaps 44L and 44R emerge. The width of the sleeve and its length is selected such that both of the belt sections 44 will easily fold up and be confined therein as shown in FIGS. 3 and 4 when the pack is not being used as a back-pack but a carrying bag of sorts or a larger one with shoulder straps carried on one shoulder. Note also, that when thus stowed inside the pouch, the angled straps 42 are pulled inside the latter by the belt and thus lie almost completely inside thereof.

For purposes of the present description, the sleeve pouch is formed by the front panel 18 and a front pouch panel 62, the inwardly-facing surface of which faces the folded belt section when housed in the pouch. Fastened to the inside surface of this front pouch panel 62 adjacent both of its open ends 60 is one part 64F of a two-part fastener. In the particular form shown, this fastener comprises one of the "pile-and-loop" type although other two-part fasteners could be substituted therefor. The other half 64R of the two-part fastener subassembly is fastened to the rearwardly-facing surface of the unfolded flaps 44L and 44R facing the front panel 18 of the bag and alongside both the entrances 60 to the pouch 14 and the fastener parts 64F as is best seen in FIG. 2. Note, however, that when the flaps are folded in as shown in FIGS. 3 and 4, the fastener parts 64R come into face-to-face juxtaposed position to their mating counterparts 64F where they fasten together to close the ends of the pouch thus confining the belt sections along with most of the angled straps attached thereto. The resulting pouch and belt subassembly leaves no portion hanging out to interfere with the use of the pack as a simple carrying bag or, in the case of a larger version equipped with shoulder straps, one that can be slung over one shoulder and carried that way with the belt stowed.

I claim:

1. In a backpack of the type having front and rear panels joined together along the side margins and at least the bottom thereof to define a bag, the improvement comprising:

a laterally-extending tubular pouch open at both ends, said pouch being disposed on the front panel of the bag;

a tapered waist-encircling belt comprising two belt halves, each having narrowed free ends and widened terminal ends, the terminal ends thereof fastened to the front panel of the bag alongside the open ends of the pouch, positioned and adapted to fold into the latter from each such open end; and strap means interconnecting each of the belt halves and the bag.

2. The backpack improvement as set forth in claim 1 in which: each belt half has a lower margin starting at the point of attachment to the front panel of the bag in the small of the wearer's back just above the buttocks, then upwardly and forwardly over the hips to points of termination in the stomach area.

3. The combination as set forth in claim 1 wherein the strap means comprises:

a pair of straps extending downwardly and forwardly from points of attachment at the side margins of the bag in the area of the wearer's shoulder blades to points of attachment with each belt half in an area just above the wearer's hips, said last-mentioned points of attachment being spaced forwardly of the open pouch ends.

4. The combination set forth in claim 1 wherein the open ends of the pouch are sized to accept the terminal ends of the belt halves.

5. A backpack comprising in combination, a pliant sided bag sized and adapted to be carried over the wearer's back, including the lumbar area, a pair of forwardly tapered belt sections each having a narrowed free end and a widened terminal end through each of which ends pass the longitudinal axis of the belt section, the terminal end being attached to the lower portion of the lumbar back-facing portion of the bag along spaced apart substantially parallel and vertically oriented lines and a pair of adjustable length straps interconnecting the respective belt sections and the bag at a point on the bag which is above the lines of belt attachment, said straps being disposed parallel to the hypotenuse of the triangles whose opposite sides are formed by the said vertically oriented lines of belt attachment and the longitudinal axes of the belt sections.

6. The combination of claim 5 and further including a horizontally oriented tubular sleeve disposed between the said two lines of the belt attachment for housing the belt sections when they are folded into the sleeve.

7. The combination of claim 6 and further including first sleeve closure means disposed at each end of the said tubular sleeve and second closure means carried by the widened terminal ends of the belt sections, positioned thereon to cooperate with the first sleeve closure means when the belt sections are folded into the sleeve.

* * * * *